US007705787B2

(12) United States Patent
Ponce De Leon et al.

(10) Patent No.: US 7,705,787 B2
(45) Date of Patent: Apr. 27, 2010

(54) COUPLED SLOT PROBE ANTENNA

(75) Inventors: Lorenzo A. Ponce De Leon, Lake Worth, FL (US); Naveed Mirza, Boynton Beach, FL (US); Paul Morningstar, North Lauderdale, FL (US)

(73) Assignee: Motorola, Inc., Schaumburg, IL (US)

( * ) Notice: Subject to any disclaimer, the term of this patent is extended or adjusted under 35 U.S.C. 154(b) by 79 days.

(21) Appl. No.: 11/691,186

(22) Filed: Mar. 26, 2007

(65) Prior Publication Data

US 2008/0238780 A1 Oct. 2, 2008

(51) Int. Cl.
*H01Q 1/24* (2006.01)

(52) U.S. Cl. ..... 343/702; 343/700 MS

(58) Field of Classification Search ..... 343/700 MS, 343/702

See application file for complete search history.

(56) References Cited

U.S. PATENT DOCUMENTS

| | | | | |
|---|---|---|---|---|
| 4,866,453 | A | 9/1989 | Nagy et al. | |
| 6,714,162 | B1 * | 3/2004 | Kadambi et al. | 343/700 MS |
| 2005/0134510 | A1 * | 6/2005 | Asai | 343/702 |
| 2005/0212706 | A1 | 9/2005 | Ying et al. | |
| 2006/0038721 | A1 | 2/2006 | Ozkar et al. | |
| 2006/0099914 | A1 * | 5/2006 | Andersson | 455/90.3 |
| 2007/0057854 | A1 * | 3/2007 | Oodachi et al. | 343/702 |
| 2007/0247373 | A1 * | 10/2007 | Egorov | 343/702 |

FOREIGN PATENT DOCUMENTS

| | | | |
|---|---|---|---|
| EP | 1067627 | A1 | 1/2001 |
| JP | 2002330022 | A | 11/2002 |
| JP | 2007028255 | A | 2/2007 |
| KR | 1020030082101 | A | 10/2003 |
| KR | 1020060122046 | A | 11/2006 |

* cited by examiner

*Primary Examiner*—Douglas W Owens
*Assistant Examiner*—Dieu Hien T Duong

(57) ABSTRACT

A coupled slot probe antenna for use with antenna structures in mobile communication devices, such as cellular telephones and other wireless communication devices. The coupled slot probe antenna includes at least one first conductive element, and a second conductive element coupled between the first conductive element and the printed circuit board (PCB) ground plane of the mobile communication device. The first and second conductive elements define a tunable coupled slot area and the coupled slot probe antenna is coupled to the PCB ground plane in such a way that the coupled slot area is near a low-impedance point of the antenna structure, wherein coupling therebetween improves the bandwidth and the efficiency of the antenna structure. The coupled slot area can be tuned by changing the size of the coupled slot area and by changing the position of the coupled slot area relative to the low-impedance point of the antenna structure.

19 Claims, 6 Drawing Sheets

10

40

60

80

100

130

COUPLED SLOT PROBE ANTENNA

BACKGROUND OF THE INVENTION

1. Field of the Invention

The invention relates to broadband antennas for use in mobile devices, such as cellular telephones and other wireless communication devices. More particularly, the invention relates to broadband antennas systems having improved bandwidth and efficiency over conventional broadband antennas used in mobile devices.

2. Description of the Related Art

Mobile communication devices, such as cellular telephones and other portable communication devices, each require some sort of antenna to establish and maintain a wireless radio link with another unit in the system, usually a wireless base station. In general, antennas (in transmit mode) generally convert radio frequency electrical currents into electromagnetic waves and (in receive mode) convert electromagnetic waves into radio frequency electrical currents. As mobile communication devices become smaller in size, the resulting space limitations have made it more difficult to design and implement antennas that are sufficiently efficient for proper and improved mobile communication device operation.

Several different types of antennas can be used in a mobile communication device. For example, a slot antenna includes a radiator formed by cutting a narrow slot in a large metal surface. The slot length is a half wavelength at the desired frequency and the width is a small fraction of a wavelength. Another antenna often used in mobile communication devices is a microstrip antenna or patch antenna. Patch antennas use a conductive material that is formed in a stripline, rectangular or other shape, and disposed on a dielectric substrate having a certain dielectric value and thickness. The shape of the conductor is chosen to achieve the desired resonant frequency and radiation pattern. Patch antennas offer relatively large degree of flexibility in antenna and wireless-device design, as they are cost-effective, easily manufactured, and can be conformed to the shape of a mobile communication device.

A derivation of the patch antenna is a planar inverted F antenna, or PIFA. Compared to a conventional patch antenna, the PIFA can resonate at a much smaller patch size for a fixed operating frequency. A conventional PIFA structure includes a conductive radiator element disposed parallel to a ground plane and insulated from the ground plane by a dielectric material, usually air. The radiator element is connected to two pins, typically disposed toward one end of the element, thus giving the appearance of an inverted letter "F" from the side view. One pin electrically connects the radiator to the ground plane; the other pin provides the antenna feed. Impedance matching is obtained by selecting correct positioning of the feed and ground contacts. Accordingly, a conventional PIFA structure is similar to a shorted rectangular microstrip patch antenna.

However, as mobile communication devices become smaller in size, conventional antennas often are too large to fit within the mobile communication device. Also, next generation mobile communication devices include operating ranges that are beyond the most efficient operating regions of conventional mobile communication device antennas. Therefore, a need exists for antennas that are small enough to fit in current and future mobile communication devices, yet still provide sufficient and even better bandwidth, multi-band operation and operating efficiency despite their reduced size.

DETAILED DESCRIPTION

Figure 1:
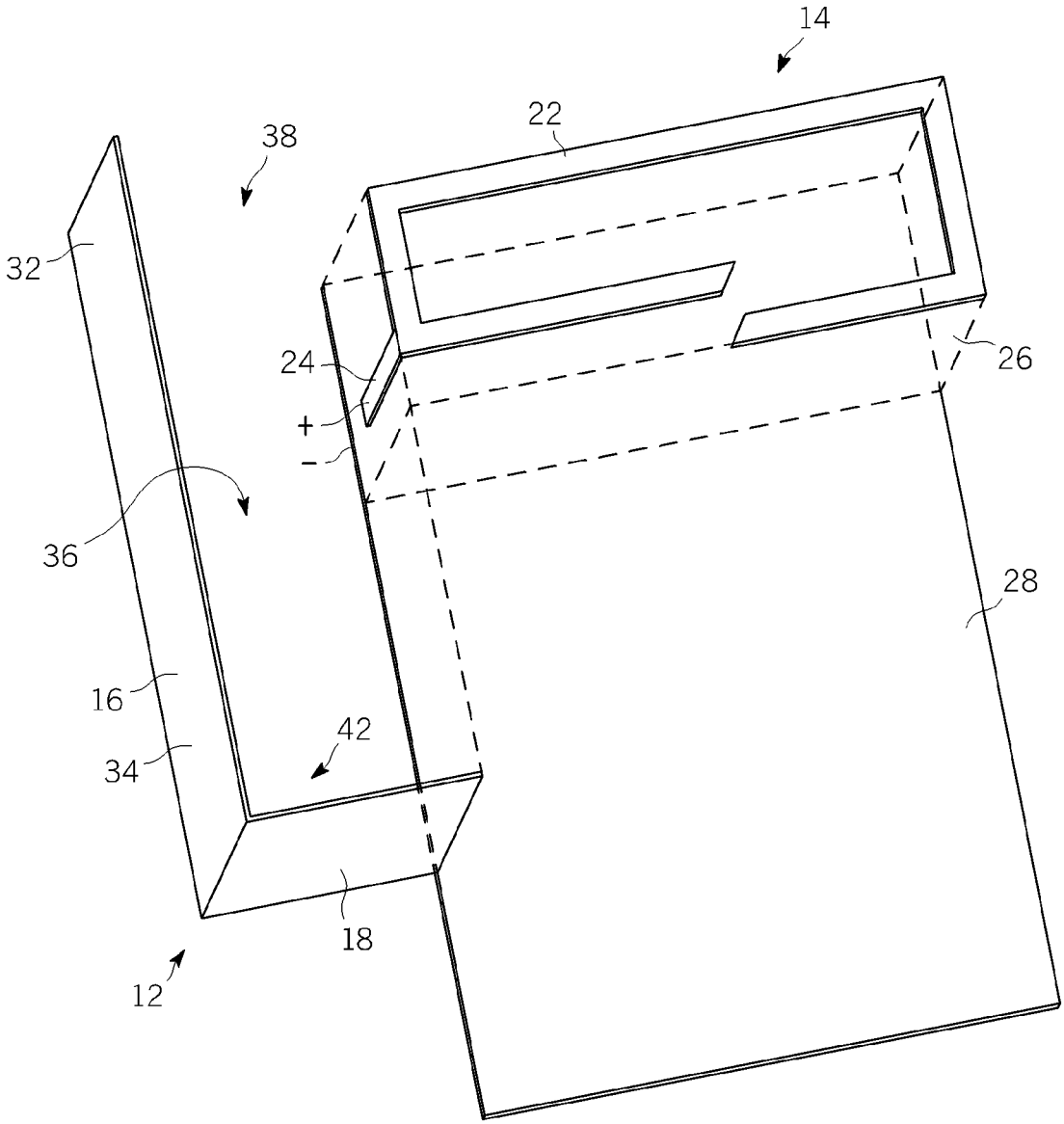
FIG. 1 is a schematic diagram of a coupled slot probe antenna in use with a folded J-pole antenna (FJA) structure.

In the following description, like reference numerals indicate like components to enhance the understanding of the coupled slot probe antenna through the description of the drawings. Also, although specific features, configurations and arrangements are discussed hereinbelow, it should be understood that such specificity is for illustrative purposes only. A person skilled in the relevant art will recognize that other steps, configurations and arrangements are useful without departing from the spirit and scope of the invention.

The coupled slot probe antenna devices described herein improve the bandwidth and efficiency of antenna structures, including antenna structures used in cellular telephones and other mobile communication devices. The coupled slot probe antenna includes at least one first conductive element, and a second conductive element coupled between the first conductive element and the printed circuit board (PCB) ground plane of the mobile communication device. The first and second conductive elements are configured in such a way that a tunable coupled slot area is created near the low-impedance point of the main antenna structure, where the electrical currents driving the main antenna structure are near a maximum. The coupled slot area, which is driven by induced magnetic currents, is oriented with respect to the main antenna structure and its low-impedance point in such a way that coupling occurs between the magnetic currents of the coupled slot area and the electrical currents of the main antenna structure. The coupled slot area can be tuned, e.g., by changing the length and/or width of the conductive elements or by moving the conductive elements and its coupled slot area relative to the PCB ground plane, in such a way that an additional resonance band can be added to the response of the main antenna structure with relatively little disturbance of the natural response of the antenna structure. Also, by adjusting the coupling of the coupled slot area to the main antenna structure, the resonance of the coupled slot area can be matched to the terminal impedance of the main antenna structure. Accordingly, the coupled slot probe antenna device allows mobile communication device antenna structures to cover a broader set of operating frequencies, thus improving device bandwidth and efficiency, while offering a configuration that still is able to fit in mobile communication devices and that does not increase overall the manufacturing cost of the mobile communication device. In this manner, the coupled slot probe antenna is well suited for next generation mobile communication devices, whose operating ranges include higher frequency ranges than conventional mobile communication devices.

The coupled slot probe antennas described hereinbelow are described in use with various antenna structures, including antenna structures that are used with various mobile communication devices, including cellular telephones. It should be understood that one or more of the coupled slot probe antennas described hereinbelow can be used with other antenna structures, including other antenna structures used in mobile communication devices.

Referring now to FIG. 1, shown is a diagram 10 of a perspective view of a coupled slot probe 12 in use with a folded J or folded J-pole antenna (FJA) structure 14, which is one type of antenna structure used in mobile communication devices. It should be understood that FIG. 1 is schematic in nature and is not drawn to scale. Also, it should be understood that, when used with mobile communication devices and other devices, the coupled slot probe 12 and/or the FJA antenna structure 14 can take on relatively complex geometries due to their conformance to device housing configurations.

The coupled slot probe 12 includes a first conductive element 16 and a second conductive element 18. Although the first and second conductive probe elements are shown as separate conductive elements coupled to one another, it should be understood that the coupled slot probe 12 can be a single conductive element formed in a suitable configuration, e.g., the configuration shown by the first and second conductive probe elements.

The FJA antenna structure 14 typically is a main antenna structure, e.g., within a mobile communication device. The FJA antenna structure 14 includes a radiating element 22 and a feedline 24 coupled to the radiating element 22 at a feedpoint. The radiating element 22 generally is formed on a dielectric substrate 26, which electrically isolates the radiating element 22 from a ground plane 28, such as the ground plane for the main printed circuit board (PCB) in a mobile communication device, i.e., the circuit board that includes most of the mobile communication device's circuitry. The feedline 24 acts as the radio frequency (RF) signal transmission line between the radiating element 22 and a signal source of the mobile communication device, shown generally by the voltage potential across the feedline 24 and the PCB ground plane 28. In general, an FJA antenna structure is a variation of a J-pole antenna in that one or both tips of the antenna radiating element are folded back toward the feedpoint.

Referring again to the coupled slot probe 12, the first conductive element 16 is a conductive probe element made of any suitable electrically-conductive material. The first conductive element 16 generally includes a probe end or probe section 32 and an opposing ground end or ground section 34. The second conductive element 18 is a conductive slot element made of any suitable electrically-conductive material. As discussed hereinabove, the first and second conductive probe elements can be made of a single piece of electrically-conductive material. The second conductive element 18 couples the first conductive element 16 to a suitable ground potential, such as the PCB ground plane 28. In this configuration, the impedance of the probe end 32 is larger than the impedance of the ground end 34.

The first conductive element 16 and the second conductive element 18 are dimensioned, oriented and configured appropriately to collectively form or create a coupled slot area or coupled slot volume, which is shown generally as a coupled slot 36. In general, the coupled slot 36 has an open end 38 near the probe end 32 of the first conductive element 16 and a closed end 42 near the ground end 34 of the first conductive element 16.

The coupled slot probe 12 is configured is such as way that the second conductive element 18 couples the ground end 34 of the first conductive element 16 to the PCB ground plane 28 so that the (high impedance) probe end 32 of the first conductive element 16 is spaced apart from the feedpoint 24 of the FJA antenna structure 14. This orients the coupled slot 36, especially the open end 38 of the coupled slot 36, near a low-impedance section or point of the FJA antenna structure 14. In general, a low impedance section of an antenna structure is a section or point where the electrical currents driving the main antenna structure 14 are near a maximum. In the FJA antenna structure 14, a low impedance section or point generally is located near the feedline 24.

Within the coupled slot 36, the electromagnetic fields present are driven by induced magnetic currents generated by the electric field that exist across the coupled slot 36. At the open end 38 of the coupled slot 36, the magnetic currents are near a maximum. Therefore, having the open end 38 of the coupled slot 36 near a low impedance (high drive current) section of the FJA antenna structure 14, a certain degree of critical or optimum coupling occurs between the magnetic currents of the coupled slot 36 to the electric currents of the FJA antenna structure 14. Such coupling allows a properly tuned coupled slot area 12 to resonate at a desired band, which allows an additional resonance band to be added to the response of the FJA antenna structure 14 with relatively little disturbance of the natural response of the FJA antenna structure 14. The resonance of the coupled slot 36 also can be matched to the terminal impedance of the FJA antenna structure 14 by adjusting or tuning the coupled slot 36.

The coupled slot 36 is tunable and dependent on a number of factors. For example, the coupled slot 36 is dependent on the ratio of the length of the coupled slot 36, as determined by the length of the first conductive element 16, to the width of the coupled slot 36, as determined by the length of the second conductive element 18. Also, the coupled slot 36 is dependent on the coupling distance of the coupled slot 36, i.e., the width of the coupled slot as defined generally by the length of the second conductive element 18.

The coupled slot 36 also is dependent on the physical location of the coupled slot 36 to the low impedance point or section of the FJA antenna structure 14. The physical location of the coupled slot 36 relative to the FJA antenna structure 14 and its low impedance point can be affected by a number of factors, including the length of the first conductive element 16 and/or the coupling location of the second conductive element 18 to the ground plane 28. That is, the size and/or overall location of the coupled slot 36 can be affected if the length of the first conductive element 16 is changed and/or the point along the ground plane 28 where the second conductive element 18 is coupled is changed.

The resonance of the coupled slot 36 can be tuned as desired using one or more of the previously-mentioned factors. For example, the desired resonance of the coupled slot 36 can be tuned by coupling the second conductive element 18 to different locations along the side of the ground plane 28 while keeping all other factors constant. However, since the tuning factors are interdependent, if one tuning factor is changed undesirably, other tuning factors can be adjusted to offset the initial factor change, therefore allowing the desired resonance, and attendant benefits, to be maintained.

As discussed, the coupled slot 36 can be tuned to resonate at a desired band, which allows an additional resonance band to be added to the response of the FJA antenna structure 14 with relatively little disturbance of the natural response of the FJA antenna structure 14. Thus, both the bandwidth and the efficiency of the FJA antenna structure 14 are enhanced. In general, the bandwidth of an antenna is the effective range of frequencies for the antenna, and the efficiency of an antenna is the ratio of power radiated by the antenna to the power supplied to the antenna.

Although the coupled slot probe 12 has been discussed hereinabove for use with an FJA antenna structure, it should be understood that the coupled slot probe 12 can be used with any antenna structure that is configured in such a way that allows the coupled slot probe 12 to be sufficiently coupled to a low impedance section or point of the antenna structure. For example, the coupled slot probe 12 can be used to improve the bandwidth and efficiency of other antenna structures, including inverted F antenna (IFA) structures, aperture coupled inverted F antenna (ACIFA) structures, coupled planar inverted F antenna (CPIFA) structures and/or other antenna structures used in cellular telephones and other mobile communication devices.

Figure 2:
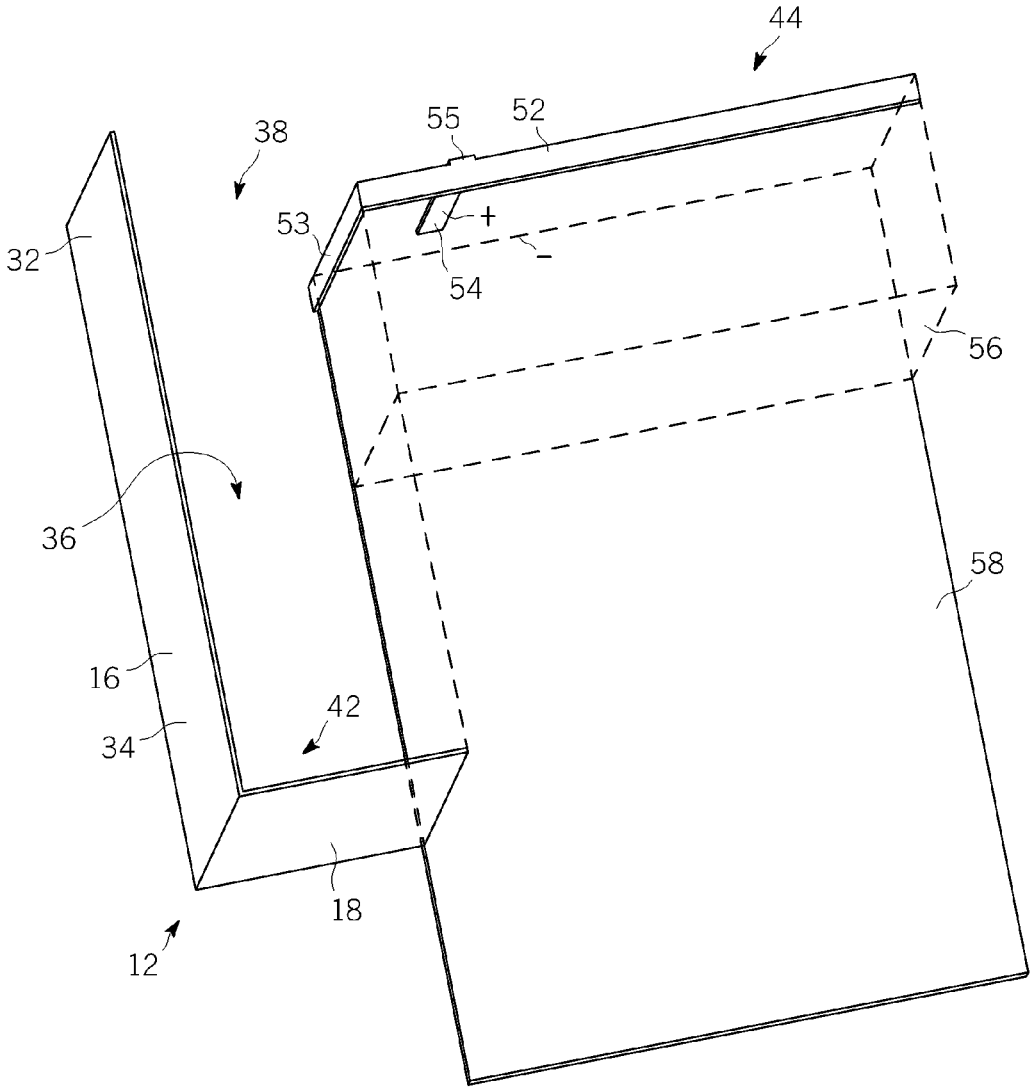
FIG. 2 is a schematic diagram of another coupled slot probe antenna in use with an inverted F antenna (IFA) structure.

Referring now to FIG. 2, shown is a diagram 40 of a perspective view of the coupled slot probe 12 in use with an inverted F antenna (IFA) structure 44, e.g., for use in a mobile communication device (not shown). It should be understood that, like FIG. 1, FIG. 2 is schematic in nature and is not drawn to scale. Also, when used with mobile communication devices and other devices, the coupled slot probe 12 and/or the IFA antenna structure 44 can take on relatively complex geometries due to their conformance to device housing configurations.

The IFA antenna structure 44 includes a radiating element 52, a low impedance element 53 coupled to the radiating element 52, and a feedline 54 coupled to the radiating element 52 at a feedpoint (shown generally as 55). The radiating element 52 generally is formed on a dielectric substrate 56, which electrically isolates the radiating element 52 from a ground plane 58, such as a PCB ground plane in a mobile communication device. The low impedance element 53 couples or connects the radiating element 52 to the PCB ground plane 58.

Like the coupled slot probe 12 in use with the FJA antenna structure 14 in FIG. 1, the coupled slot probe 12 in use with the IFA antenna structure 44 in FIG. 2 couples the ground end 34 of the first conductive element 16 to the PCB ground plane 58 so that the (high impedance) probe end 32 of the first conductive element 16 is spaced near the low impedance element 53 and spaced apart from the feedpoint 54 of the IFA antenna structure 44. Such orientation also positions the open end 38 of the coupled slot 36 near the low impedance element 53 of the IFA antenna structure 44.

Like the coupled slot probe 12 in use with the FJA antenna structure 14 in FIG. 1, the coupled slot probe 12 in use with the IFA antenna structure 44 in FIG. 2 provides a suitable degree of critical or optimum coupling of the magnetic currents of the coupled slot 36 to the electric currents of the IFA antenna structure 44. The coupling provided by this arrangement allows the coupled slot area 12, when properly tuned, to resonate at a desired band, thus allowing an additional resonance band to be added to the response of the IFA antenna structure 44 with relatively little disturbance to the natural response of the IFA antenna structure 44. Accordingly, the bandwidth and the efficiency of the IFA antenna structure 44 are enhanced.

Figure 3:
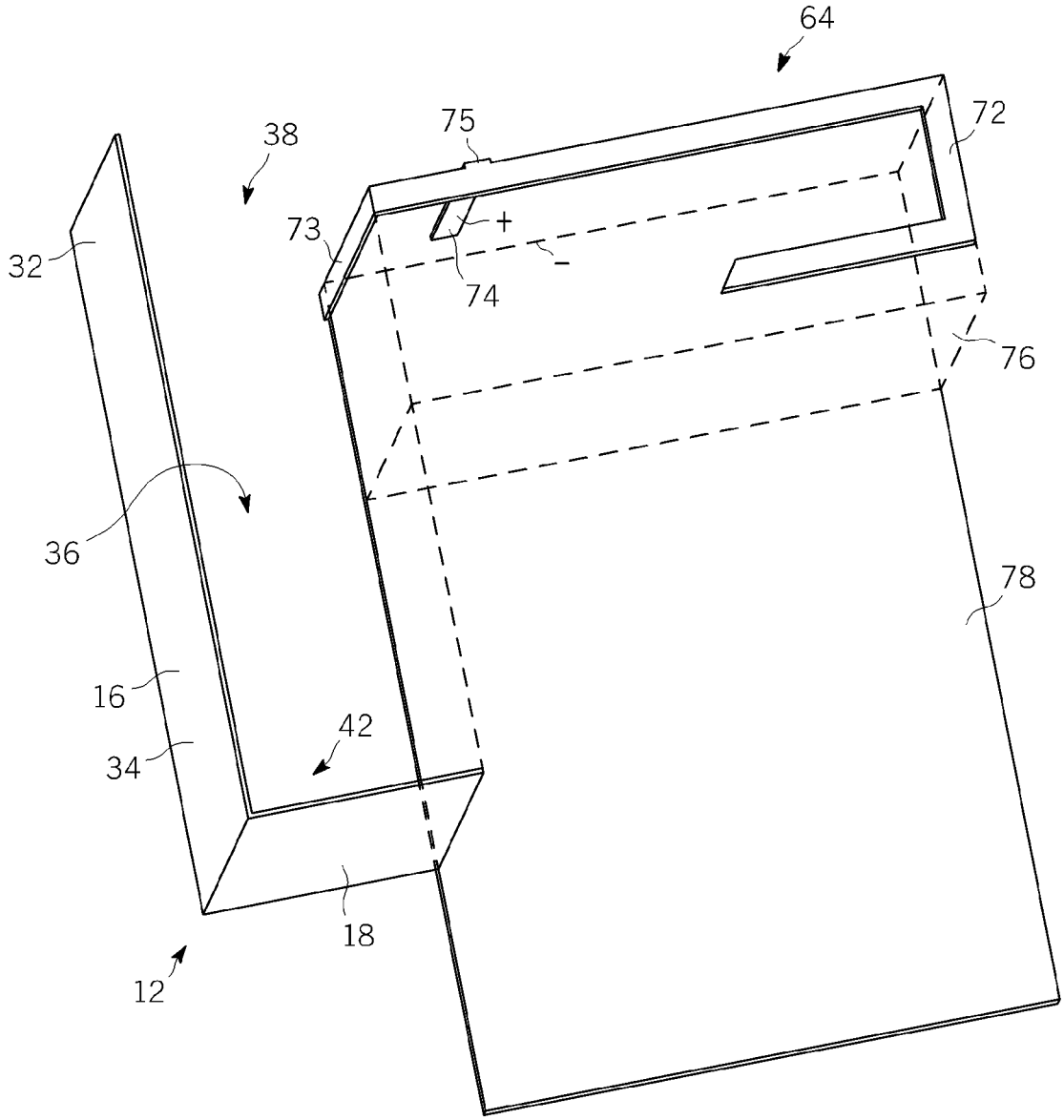
FIG. 3 is a schematic diagram of another coupled slot probe antenna in use with an aperture coupled inverted F antenna (ACIFA) structure.

Referring now to FIG. 3, shown is a diagram 60 of a perspective view of the coupled slot probe 12 in use with an aperture coupled inverted F antenna (ACIFA) structure 64, e.g., for use in a mobile communication device (not shown). It should be understood that FIG. 3 is schematic in nature and is not drawn to scale. Also, when used with mobile communication devices and other devices, the coupled slot probe 12 and/or the ACIFA antenna structure 64 can take on relatively complex geometries due to their conformance to device housing configurations.

The ACIFA antenna structure 64 includes a radiating element 72, a low impedance element 73 coupled to the radiating element 72, and a feedline 74 coupled to the radiating element 72 at a feedpoint (shown generally as 75). The radiating element 72 generally is formed on a dielectric substrate 76, which electrically isolates the radiating element 72 from a ground plane 78, such as a PCB ground plane in a mobile communication device. The low impedance element 73 couples or connects the radiating element 72 to the PCB ground plane 78.

Like the coupled slot probe 12 in use with other antenna structures previously described hereinabove, the coupled slot probe 12 in use with the ACIFA antenna structure 64 in FIG. 2 couples the ground end 34 of the first conductive element 16 to the PCB ground plane 78 so that the (high impedance) probe end 32 of the first conductive element 16 is spaced near the low impedance element 73 and spaced apart from the feedpoint 74 of the ACIFA antenna structure 64. Such orientation also positions the open end 38 of the coupled slot 36 near the low impedance element 73 of the ACIFA antenna structure 64.

Like the coupled slot probe 12 in use with other antenna structures, as described hereinabove, the coupled slot probe 12 in use with the ACIFA antenna structure 64 in FIG. 3 provides a suitable degree of critical or optimum coupling of the magnetic currents of the coupled slot 36 to the electric currents of the ACIFA antenna structure 64. The coupling provided by this arrangement allows the coupled slot area 12, when properly tuned, to resonate at a desired band, thus allowing an additional resonance band to be added to the response of the ACIFA antenna structure 64 with relatively little disturbance to the natural response of the ACIFA antenna structure 64. Accordingly, the bandwidth and the efficiency of the ACIFA antenna structure 64 are enhanced.

Figure 4:
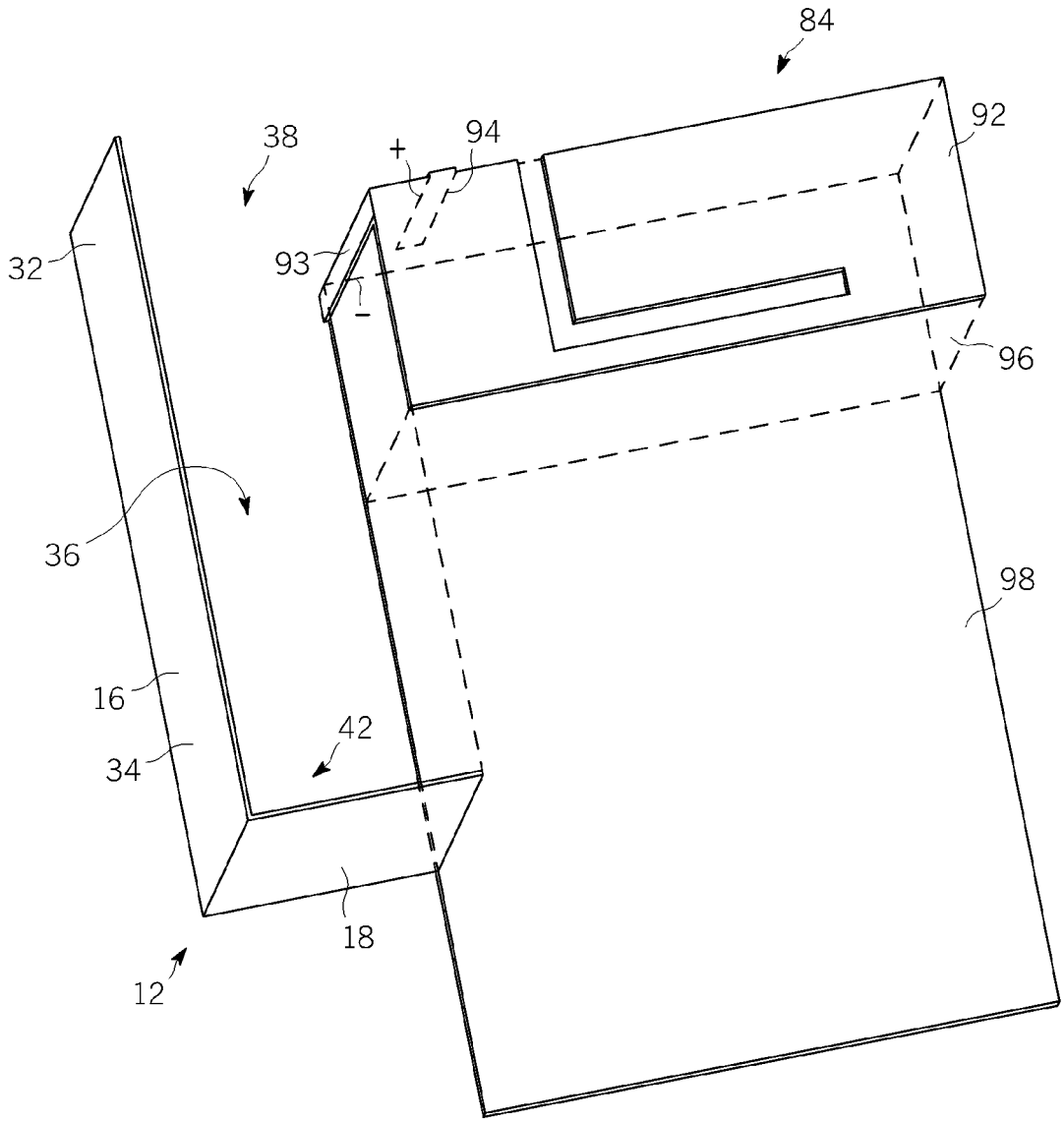
FIG. 4 is a schematic diagram of another coupled slot probe antenna in use with a coupled planar inverted F antenna (CPIFA) structure.

Referring now to FIG. 4, shown is a diagram 80 of a perspective view of the coupled slot probe 12 in use with a coupled planar inverted F antenna (CPIFA) structure 84, e.g., for use in a mobile communication device (not shown). It should be understood that FIG. 4 is schematic in nature and is not drawn to scale. Also, when used with mobile communication devices and other devices, the coupled slot probe 12 and/or the CPIFA antenna structure 84 can take on relatively complex geometries due to their conformance to device housing configurations.

The CPIFA antenna structure 84 includes a radiating element 92, a low impedance element 93 coupled to the radiating element 92, and a feedline 94 coupled to the radiating element 92 at a feedpoint (shown generally as 95). The radiating element 92 generally is formed on a dielectric substrate 96, which electrically isolates the radiating element 92 from a ground plane 98, such as a PCB ground plane in a mobile communication device. In addition to one end being coupled to the radiating element 92, the low impedance element 93 couples or connects the radiating element 92 to the PCB ground plane 98.

Like the coupled slot probe 12 in use with other antenna structures previously described hereinabove, the coupled slot probe 12 in use with the CPIFA antenna structure 84 in FIG. 4 couples the ground end 34 of the first conductive element 16 to the PCB ground plane 98 so that the (high impedance) probe end 32 of the first conductive element 16 is spaced near the low impedance element 93 and spaced apart from the feedpoint 94 of the CPIFA antenna structure 84. Such orientation also positions the open end 38 of the coupled slot 36 near the low-impedance element 93 of the CPIFA antenna structure 84.

Like the coupled slot probe 12 in use with other antenna structures, as described hereinabove, the coupled slot probe 12 in use with the CPIFA antenna structure 84 in FIG. 3 provides a suitable degree of critical or optimum coupling of the magnetic currents of the coupled slot 36 to the electric currents of the CPIFA antenna structure 84. The coupling provided by this arrangement allows the coupled slot area 12, when properly tuned, to resonate at a desired band, thus allowing an additional resonance band to be added to the response of the CPIFA antenna structure 84 with relatively little disturbance to the natural response of the CPIFA antenna structure 84. Accordingly, the bandwidth and the efficiency of the CPIFA antenna structure 64 are enhanced.

Figure 5:
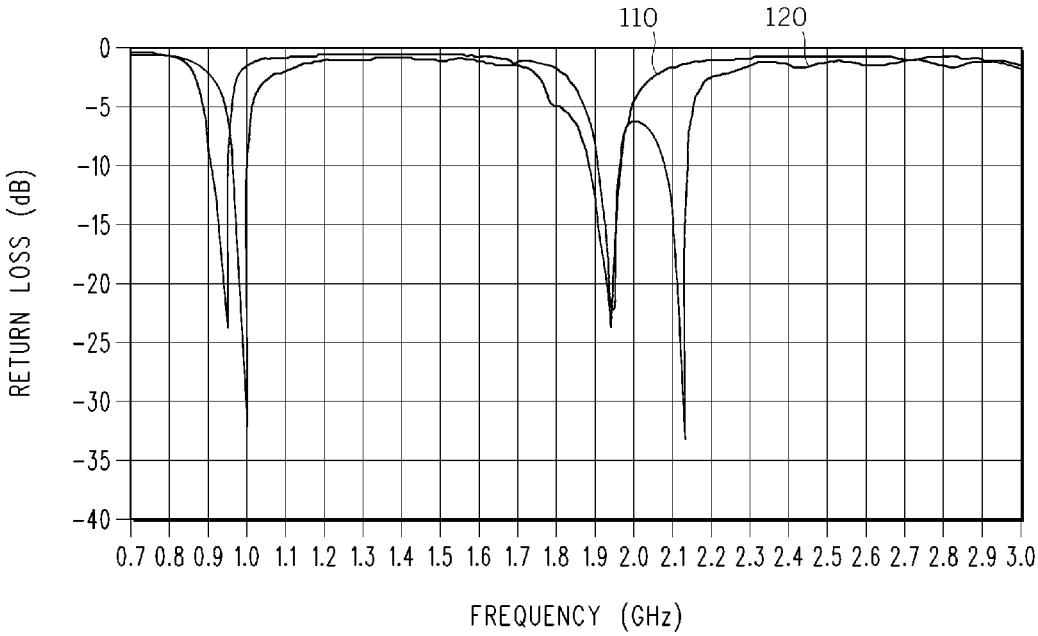
FIG. 5 is a graphical diagram of a return loss plot as a function of operating frequency of an antenna using a CPIFA and an antenna using a CPIFA with the coupled slot probe antenna.

Referring now to FIG. 5, shown is a graphical diagram 100 of a return loss plot as a function of operating frequency of an antenna using a CPIFA and an antenna using a CPIFA with the coupled slot probe antenna 12. The diagram 100 includes a first plot 110 of the return loss plot as a function of operating frequency of an antenna using a conventional CPIFA, and a second plot 120 of the return loss plot as a function of operating frequency of an antenna using a conventional CPIFA with the coupled slot probe antenna 12. As can be seen, the use of the coupled slot probe antenna 12 with the CPIFA antenna structure improves the return loss at existing frequency ranges, as well as adds an additional frequency response band at a higher frequency range.

Figure 6:
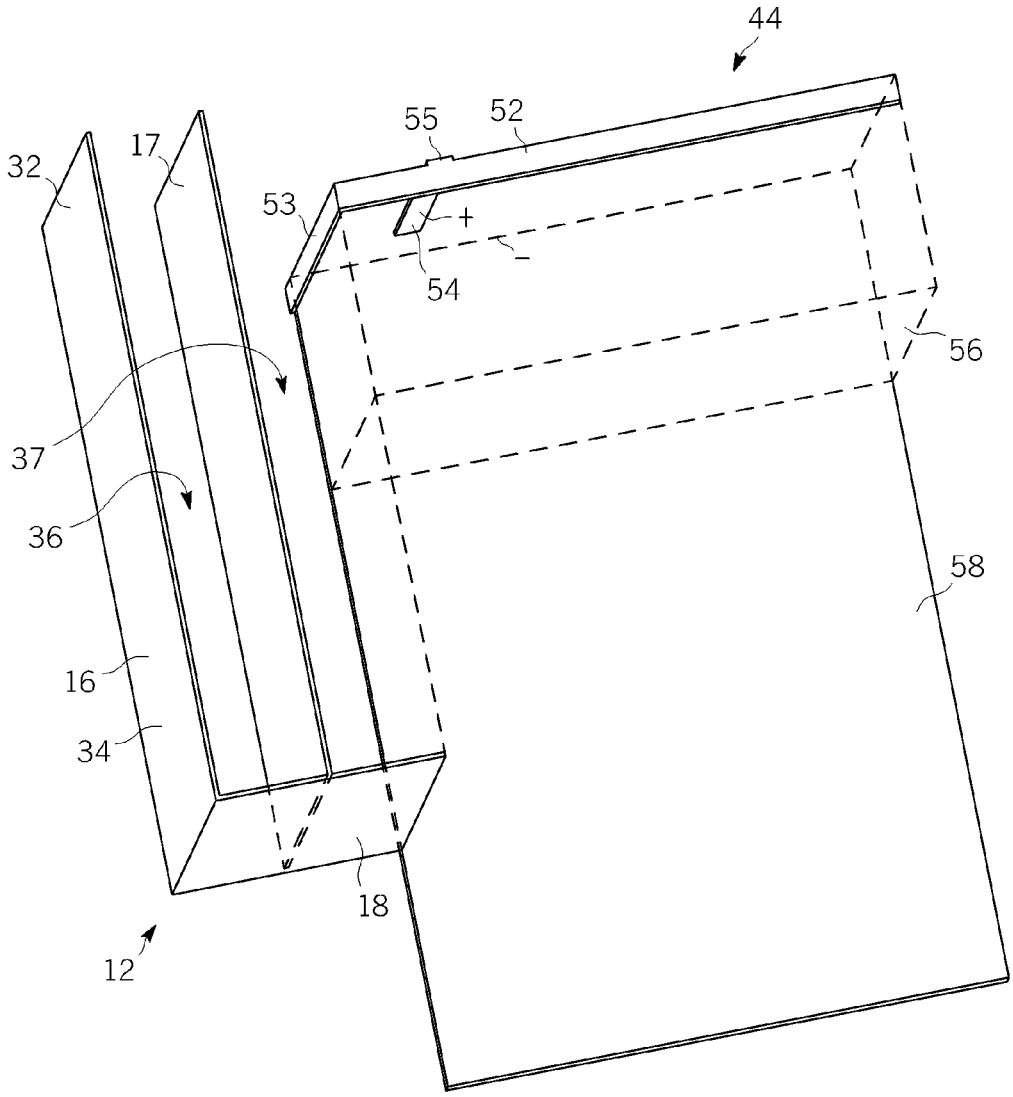
FIG. 6 is a schematic diagram of a coupled slot probe antenna, having an alternative configuration, in use with an inverted F antenna (IFA) structure.

Although the coupled slot probe 12 has been shown and described herein with one first conductive element 16, it should be understood that the coupled slot probe 12 can include one or more additional (multiple) conductive elements, which create multiple coupled slots. For example, referring now to FIG. 6, shown is a schematic diagram 130 of a coupled slot probe antenna 12 with multiple first conductive elements 16, 17. The coupled slot probe antenna 12 is shown in use with an inverted F antenna (IFA) structure, such as the IFA structure 44 shown in FIG. 2, although the coupled slot probe 12 can be used with any other suitable antenna structure. The multiple first conductive elements 16, 17 create multiple coupled slot areas or slots, shown as coupled slots 36, 37. The additional coupled slot or slots can add additional resonance bands to the response of the associated antenna structure.

The protocols used to operate all or a portion of the mobile communication devices described herein may include one or more of the following: cordless telephony protocols, such as but not limited to Digital Enhanced Cordless Telephony (DECT), mobile telephony call signaling, e.g., the integrated dispatch enhanced network (iDEN) Network, time division multiple access (TDMA), code division multiple access (CDMA), CDMA-2000, CDMA diversity, and global system for mobile communications (GSM); IP-based Telephony Signaling, e.g., Packet Cable Network-based Call Signaling (NCS), Packet Cable Duos, session initiation protocol (SIP), mobile data service protocols, such as but not limited to general packet radio service (GPRS), simple gateway control protocol (SGCP), media gateway control protocol (MGCP) and any protocol in accordance with the H.323 standard; the Public Switched Telephone Network (PSTN); and local network interfaces that support voice and data traffic, such as but not limited to Bluetooth, and any protocols in accordance with the following standards: IEEE 802.11x, including IEEE 802.11b, IEEE 802.11a, IEEE 802.11g, IEEE 802.11h and IEEE 802.11e, IEEE 802.16 and HomeRF™. Also, the mobile communication devices can include mobile devices that can connect to a wired local network in accordance with the Home Phoneline Networking Alliance (HPNA), the Home Plug Powerline Alliance, 10/100BaseT Ethernet, universal serial bus (USB) and IEEE 1394, broadband networking including hybrid-fiber coax network, which includes Data Over Cable Service Interface Specification (DOCSIS) compliant protocols and IP Telephony protocols, Digital Subscriber Line (DSL) Modems and Networks, Fixed Wireless Networks (e.g., multichannel multipoint distribution service (MMDS) and local multipoint distribution service (LMDS)), Bluetooth Protocol Specification, and PacketCable™ and Network-Based Call Signaling Protocol Specification (NCS).

It will be apparent to those skilled in the art that many changes and substitutions can be made to the coupled slot probe antenna devices herein described without departing from the spirit and scope of the invention as defined by the appended claims and their full scope of equivalents.

The invention claimed is:

1. A coupled slot probe antenna for coupling to an antenna structure, wherein the antenna structure has a radiating element coupled to a ground plane by a low-impedance element, a feedline coupled to the radiating element at a feedpoint, and a low-impedance area within which the low-impedance element resides, the coupled slot probe antenna comprising:

at least one first planar conductive element having a probe end and an opposing ground end; and a second planar conductive element having a first end coupled to the ground end of the first conductive element and a second end coupled to the ground plane of the radiating element, wherein the first end of the second planar conductive element is coupled to the ground end of the first planar conductive element in such a way that the plane of the second planar conductive element is orthogonal to the plane of the first planar conductive element, wherein the first and second conductive elements are configured in such a way that the coupled slot probe antenna defines a coupled slot area, wherein the second end of the second conductive element is coupled to the ground plane in such a way that both the first and second conductive elements are orthogonal to the plane of the radiating element and orthogonal to the ground plane, wherein the first planar conductive element is spaced apart from the feedpoint and directly facing the low-impedance element, and wherein the first planar conductive element is coupled to the ground plane only through the second planar conductive element, and wherein, when the coupled slot area is near the low-impedance area of the antenna structure, coupling occurs between the coupled slot area and the low-impedance area of the antenna structure in such a way that increases at least one of the bandwidth and the efficiency of the antenna structure.

2. The antenna as recited in claim 1, wherein the coupled slot area has a length and a width defined by the first and second conductive elements, and wherein the coupling between the coupled slot area and the low-impedance area of the antenna structure is based on the ratio of the length of the coupled slot area to the width of the coupled slot area.

3. The antenna as recited in claim 1, wherein the coupled slot probe antenna is coupled to the ground plane in such a way that the length of the second conductive element defines a coupling distance of the coupled slot area, and wherein the coupling between the coupled slot area and the low-impedance area of the antenna structure is based on the coupling distance of the coupled slot area.

4. The antenna as recited in claim 1, wherein the coupled slot probe antenna is coupled to the ground plane in such a way that the coupling between the coupled slot area and the low-impedance area of the antenna structure is based on the location of the coupling of the second end of the second conductive element to the ground plane.

5. The antenna as recited in claim 1, wherein the coupled slot area includes an open end at the probe end of the first conductive element and a closed end at the ground end of the first conductive element, and wherein the coupling between the coupled slot area and the low-impedance area of the antenna structure is based on the location of the open end of the coupled slot area to the low-impedance area of the antenna structure.

6. The antenna as recited in claim 1, wherein the coupled slot probe antenna is tunable based on at least one of the size of the coupled slot area and the location of the coupled slot area to the low-impedance area of the antenna structure.

7. The antenna as recited in claim 1, wherein the probe end of the first conductive element has a first impedance, wherein the ground end of the first conductive element has a second impedance that is less than the first impedance, and wherein the coupled slot probe antenna is coupled to the ground plane in such a way that the probe end of the first conductive element is closer to the low-impedance area of the antenna structure than the ground end of the first conductive element.

8. The antenna as recited in claim 1, wherein the antenna structure is configured in such a way that when the coupled slot area is near the feedpoint of the antenna structure, coupling occurs between the coupled slot area and the low-impedance area of the antenna structure that increases at least one of the bandwidth and the efficiency of the antenna structure.

9. The antenna as recited in claim 1, wherein the antenna structure is selected from the group consisting of a folded J-pole antenna (FJA) structure, an inverted F antenna (IFA) structure, and an aperture coupled inverted F antenna (ACIFA) structure.

10. A mobile communication device, comprising:

a ground plane for a printed circuit board including radio frequency (RF) circuitry for operation of the mobile communication device;

an antenna structure having a radiating element coupled to the ground plane by a low-impedance element, a feedline coupled to the radiating element at a feedpoint, and a low-impedance area within which the low-impedance element resides; and a coupled slot probe antenna coupled to the ground plane, wherein the coupled slot probe antenna includes a first planar conductive element and a second planar conductive element coupled to the first conductive element in such a way that the plane of the second planar conductive element is orthogonal to the plane of the first planar conductive element and coupled to the ground plane in such a way that both the first and second conductive elements are orthogonal to the plane of the radiating element and orthogonal to the ground plane, wherein the coupled slot probe antenna is configured in such a way that defines a coupled slot area, wherein the first planar conductive element is spaced apart from the feedpoint and directly facing the low-impedance element, wherein the first planar conductive element is coupled to the ground plane only through the second planar conductive element, and wherein when the coupled slot area is near the low-impedance area of the antenna structure, coupling occurs between the coupled slot area and the low-impedance area of the antenna structure in such a way that adds at least one resonance band to the bandwidth of the antenna structure.

11. The device as recited in claim 10, wherein the coupled slot probe antenna includes at least one first conductive element having a probe end and an opposing ground end, and a second conductive element having a first end coupled to the ground end of the first conductive element and a second end coupled to the ground plane of the radiating element.

12. The device as recited in claim 11, wherein the probe end of the first conductive element has a first impedance, wherein the ground end of the first conductive element has a second impedance that is less than the first impedance, and wherein the coupled slot probe antenna is coupled to the ground plane in such a way that the probe end of the first conductive element is closer to the low-impedance area of the antenna structure than the ground end of the first conductive element.

13. The device as recited in claim 10, wherein the coupled slot area has a length and a width, and wherein the coupling between the coupled slot area and the low-impedance area of the antenna structure is based on the ratio of the length of the coupled slot area to the width of the coupled slot area.

14. The device as recited in claim 10, wherein the coupled slot area has a length and a width, wherein the width of the coupled slot area defines a coupling distance, and wherein the coupling between the coupled slot area and the low-impedance area of the antenna structure is based on the coupling distance of the coupled slot area.

15. The device as recited in claim 10, wherein the coupled slot probe antenna is coupled to the ground plane in such a way that the coupling between the coupled slot area and the low-impedance area of the antenna structure is based on the location of the coupling of the coupled slot probe antenna to the ground plane.

16. The device as recited in claim 10, wherein the coupled slot probe antenna is configured in such a way that the coupled slot area includes an open end and a closed end, and wherein the coupling between the coupled slot area and the low-impedance area of the antenna structure is based on the location of the open end of the coupled slot area to the low-impedance area of the antenna structure.

17. The device as recited in claim 10, wherein the radiating element is a planar radiating element oriented in a first plane, wherein the coupled slot probe antenna includes a first planar conductive element and a second planar conductive element, and wherein the coupled slot probe antenna is coupled to the ground plane in such a way that the first planar conductive element and the second planar conductive element are orthogonal to the first plane.

18. The device as recited in claim 10, wherein the coupled slot probe antenna is tunable based on at least one of the size of the coupled slot area and the location of the coupled slot area to the low-impedance area of the antenna structure.

19. The device as recited in claim 10, wherein the antenna structure is selected from the group consisting of a folded J-pole antenna (FJA) structure, an inverted F antenna (IFA) structure, and an aperture coupled inverted F antenna (ACIFA) structure.

* * * * *